United States Patent [19]

Schoenlein

[11] 4,350,454

[45] Sep. 21, 1982

[54] RIBBON CARTRIDGE INCLUDING HUB BRAKE

[75] Inventor: William J. Schoenlein, Levittown, N.Y.

[73] Assignee: IBM Patent Operations, Lexington, Ky.

[21] Appl. No.: 176,955

[22] Filed: Aug. 11, 1980

[51] Int. Cl.[3] ..... B41J 33/14

[52] U.S. Cl. ..... 400/234; 400/208; 242/75.43; 242/156; 242/199

[58] Field of Search ..... 400/207, 208, 234; 242/75, 43, 156, 156.1, 156.2, 197, 198, 199, 200

[56] References Cited

U.S. PATENT DOCUMENTS

| | | | |
|---|---|---|---|
| 1,284,448 | 11/1918 | Power | 242/75.43 |
| 2,869,684 | 1/1959 | Tarbuck | 242/75.43 X |
| 3,464,533 | 9/1969 | Gallant | 400/208 |
| 4,010,839 | 3/1977 | Guerrini et al. | 400/207 |
| 4,174,078 | 11/1979 | Brooks | 242/156.2 X |

FOREIGN PATENT DOCUMENTS

| | | | |
|---|---|---|---|
| 2003832 | 3/1979 | United Kingdom | 400/234 |
| 1559408 | 1/1980 | United Kingdom | 400/234 |

OTHER PUBLICATIONS

*IBM Technical Discosure Bulletin,* "Ribbon Drag Wire", Lenney, vol. 18, No. 4, Sep. 1975, p. 1093.

*Primary Examiner*—Ernest T. Wright, Jr.
*Attorney, Agent, or Firm*—Thomas L. Tully

[57] ABSTRACT

A ribbon cassette or cartridge comprising a housing having a hub element supporting a core having a ribbon wound thereon, such as a typewriter or printer ribbon, and adapted to releasably engage said core for rotation thereon. The hub element comprises at least two portions, at least one portion being fixed to the housing of said cassette or cartridge, and at least one other portion which is attached for movement between a locking position, in which it makes frictional engagement with the ribbon core to substantially prevent rotation of said core on said hub element, and a release position in which it is moved out of frictional engagement with said ribbon core to permit rotation of said core on said hub element. The moveable hub portion comprises an arm which extends therefrom beyond the outer circumference of the wound ribbon and which is adapted to be engaged by the free end of the ribbon, during unwinding thereof, to move said other hub portion to the release position to release the frictional engagement between the hub and core when tension is applied to withdraw said ribbon from said core.

7 Claims, 7 Drawing Figures

RIBBON CARTRIDGE INCLUDING HUB BRAKE

BACKGROUND OF THE INVENTION

The present invention relates to ribbon cartridges which contain a ribbon which is wound on a supply core and which is adapted to be continuously withdrawn from said supply core and from said cartridge case for typing or printing use and to be returned to a take-up core within said cartridge case subsequent to said use.

A wide variety of cartridges of this type are commercially-available for use on a wide variety of typing and printing machines. Reference is made to British Pat. No. 1,559,408 and British Published Application No. 2,003,832A for their disclosure of two of the many types and styles of ribbon cartridges which may be modified to incorporate the novel features of the present invention.

An important problem encountered with ribbon cartridges in which a wound ribbon must be moved from a supply core to a take-up core, passing through a transfer station, is to maintain the ribbon under tension, i.e., prevent it from unwinding from the supply core in the absence of a pulling force of the type exerted by the typing or printing machine. Unless so restrained, the supply core can rotate in increments under the effects of vibration or other forces encountered during handling or shipping of the cartridge and even while the cartridge is mounted on an electric typewriter or printer which vibrates to some extent. Such rotation can cause an excessive slack in the ribbon within or outside the cartridge whereby the ribbon can become tangled or snagged within the cartridge or on the ribbon guides of the typewriter or printer and can break.

Various means are provided in various ribbon cartridges to maintain the ribbon under tension, such as spring arms biased against the ribbon wound on both the supply and take-up spools, a drag means on the ribbon after it leaves the supply spool, a pawl and ratchet on the supply core, etc.

While these devices are effective for their intended purposes, they do present other problems such as multiplicity or complexity of parts, lack of uniformity of tension during use, lack of control of the supply core, and other deficiencies.

SUMMARY OF THE INVENTION

The present invention provides a ribbon cartridge or cassette having a ribbon-supply spool, a ribbon take-up spool, means for guiding the ribbon from the supply spool, outside the cartridge, back into the cartridge and onto a take-up spool, the invention being characterized by the presence of a support hub for the core of the ribbon supply spool, which hub comprises a releaseable braking means including a release lever which is engaged and releasable by the action of the ribbon when the ribbon is under the amount of tension exerted by the ribbon feeding mechanism of the typewriter or printer. Thus, the present cartridge includes a supply core hub which is adapted to receive the core of a ribbon supply spool, said hub being adjustable between a locking position, in which it frictionally engages the inside circumference of the supply core to prevent rotation of said core, and a release position, in which said frictional engagement is released and said supply core is freely rotatable on said hub.

THE INVENTION

Figure 1:
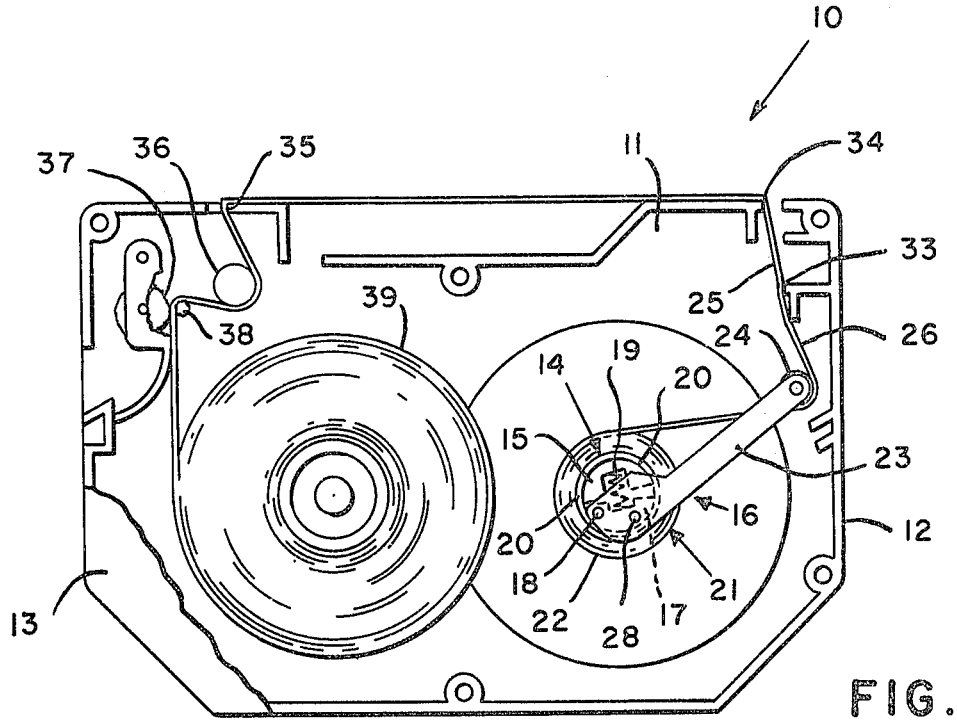
FIG. 1 is a plan view of a ribbon cartridge according to one embodiment of the present invention, a portion of the top cover plate being cut away for purposes of illustration.

Referring to the drawing, the cartridge illustrated by FIG. 1 is of the Qume 6240 type suitable for use in a conventional IBM typewriter. It is similar in external appearance to commercially-available ribbon cartridges and is adapted to feed a wound ribbon from the supply spool, through the external transfer station, and back onto a take-up spool under the activation of the ribbon-feeding mechanism of the typewriter.

Thus the cartridge 10 is molded from plastic in the form of two major sections, namely the base plate 11, which includes the side walls 12 and is the basic receptacle for the ribbon spools 21 and 39, and a cover plate 13 which is adapted to be snapped onto the base plate 11 to confine the ribbon spools 21 and 39 therein.

Since the novel features of the present invention involve only the ribbon supply spool hub 14, the present description is essentially limited to such features. Thus in the embodiment of FIGS. 1 to 3, as shown most clearly in FIG. 2, the supply spool hub 14 comprises a fixed hemicylindrical hub post 15 molded to the base plate 11 of the cartridge 10, a movable hub member 16 having a hemicylindrical brake section 17, a pivot pin 18 also molded to the base plate 11 to pivotally support the movable hub member 16, and a spring 19 supported in position between said hub post 15 and said brake section 17 and adapted to bias said hub member 16 away from said hub post 15 sufficiently to cause the supply spool hub 14 to frictionally engage the inner circumference of the core 20 of a ribbon spool 21 carrying a length of wound ribbon 22 so that the hub 14 can function as a brake to prevent the core 20 from rotating thereon.

Figure 2:
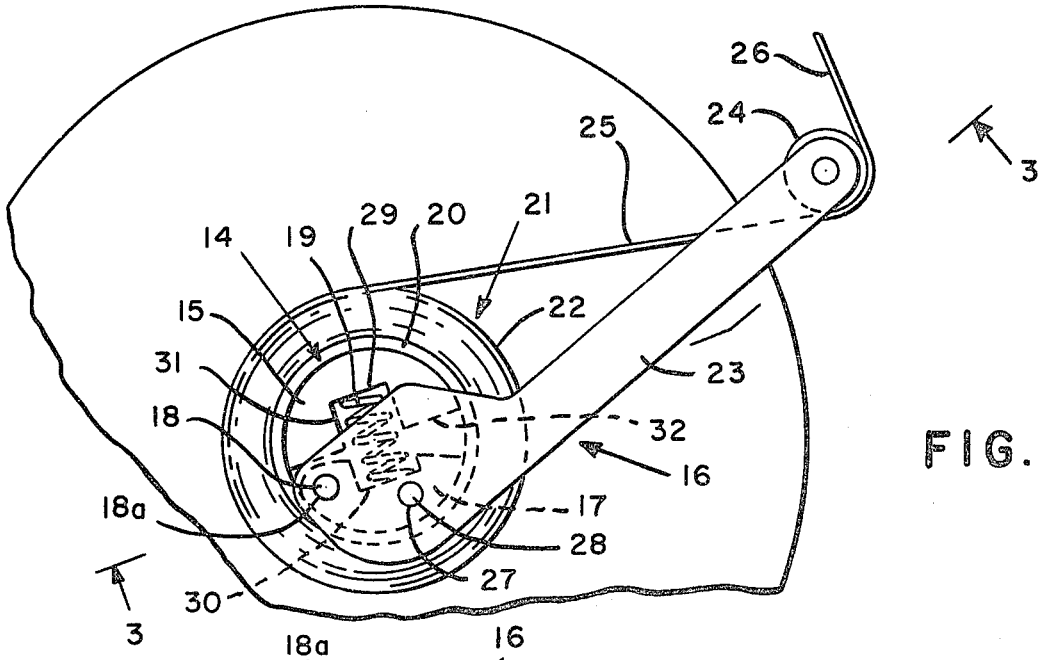
FIG. 2 is a magnified top view of a ribbon supply spool mounted on a cartridge hub according to the embodiment of FIG. 1, the hub being retracted sufficiently by the force of ribbon against the hub lever to permit rotation of the supply spool on the hub.
Figure 3:
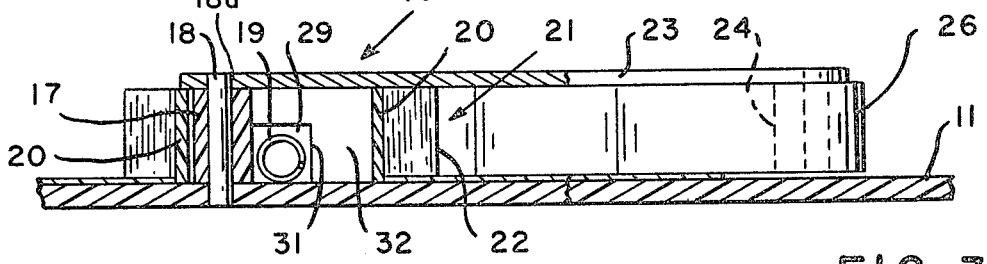
FIG. 3 is a view taken along the line 3—3 of FIG. 2.

As shown most clearly by FIG. 3, the pivotable hub member 16 of the hub 14 also comprises a lever arm 23 which may be integral with said hemicylindrical brake section 17 and which extends substantially radially from the pivot point of said brake section 17 to a point beyond the outermost convolution of the wound supply ribbon 22, at which point the lever arm 23 is provided with an idler roller 24 which is rotatably attached to the arm 23 and extends parallel to and across the face of the ribbon 22 so that the rear uncoated face 25 of the ribbon 22 engages the idler roller 24 as the continuous length 26 of ribbon 22 is drawn from the supply spool 21. In the embodiment illustrated by FIGS. 1 to 3, the lever arm 23 is not integral with the brake section 17 but is removably united thereto by means of arm hole 18*a* which is frictionally engaged on the extension of pivot pin 18 and arm hole 27 which is frictionally engaged on a fixed pin 28 projecting from the upper surface of the brake section 17. The arm 23 is removably attached to pins 18 and 28 so that the brake section 17 and spring 19 can be assembled in place and the ribbon 22 and spool 21 can be mounted on the hub 14 before the lever arm 23 is attached thereover.

As can be readily understood, and as illustrated by FIG. 1 of the drawing, the application of tension to the free end of ribbon 22, as caused by the ribbon feeding mechanism of the typewriter, will cause the lever arm 23 to be raised or pivoted slightly in the counterclockwise direction until the frictional engagement between the brake section 17, which also pivots with the lever arm 23, and the core 20 is reduced sufficiently to permit the core 20 to rotate in the clockwise direction on the hub 14 whereby ribbon 22 can be drawn from the supply spool 21. The release of the braking action is gradual as the tension on the ribbon length 26 being removed exceeds the force with which the hub brake section 17 is urged against the core 20 by the spring 19. At such point the ribbon length 26 is withdrawn under substantially constant tension from the supply spool 21, any release of such tension as may be caused by ribbon breakage or cessation of use permitting the lever arm 23 and brake section 17 to be pivoted clockwise to cause the ribbon core 20 to be locked to the hub 14.

As illustrated by FIG. 2, the spring 19 is seated between the hub post 15 and the pivotable brake member 17 of the hub member 16 to bias the latter in a direction away from the hub post 15 with sufficient force to lock in the absence of a pulling force on the free end of the ribbon length 26, which force will move the lever arm 23 to compress the spring 19 and release the frictional engagement between the hub 14 and the core 20. In the embodiment illustrated, the spring 19 is seated in recesses 29 and 30 provided in the inner walls of the hub post 15 and the brake section 17, respectively, and is maintained in alignment by the central opening 31 in the diametric central wall 32 of the hub post 15.

The pivotable hub member 16 may be a unitary molded piece comprising the brake section 17 and the lever arm 23 united in the area of the pivot pin 18, as illustrated, so that there is some flexibility or spring action between the lever arm 23 and the brake section 17. This provides smoother operation of the ribbon feed and greater uniformity and control of the ribbon tension. However, it is possible to use a pivotable hub member in which the brake section 17 and the lever arm 23 are separate components, formed from plastic or metal and united by means of screws or pins in such manner that movement of the lever arm 23 causes pivoting movement of the brake section 17.

Obviously, the size and strength of the spring 19 and the length of the lever arm 23 can be varied depending upon the size of the ribbon cartridge 10, the diameter of the wound ribbon 22 and the amount of tension desired on the ribbon 22. The use of an idler roller 24 on the lever arm 23 is preferred for smooth operation and friction reduction, for engagement with the rear surface 25 of the ribbon length 26 being withdrawn from the ribbon spool 21.

Figure 4:
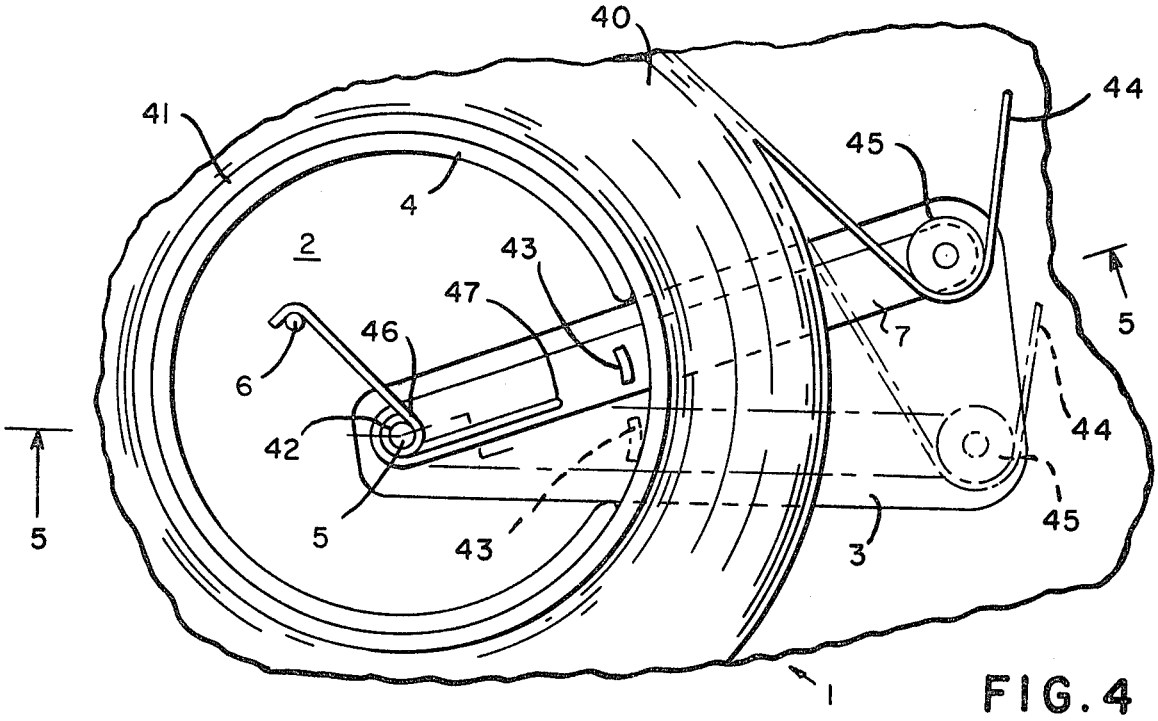
FIG. 4 is a magnified top view of a ribbon supply spool mounted on a cartridge hub according to another embodiment of the present invention, the hub lever arm being shown in both release position (solid lines) and locking position (broken lines)
Figure 5:
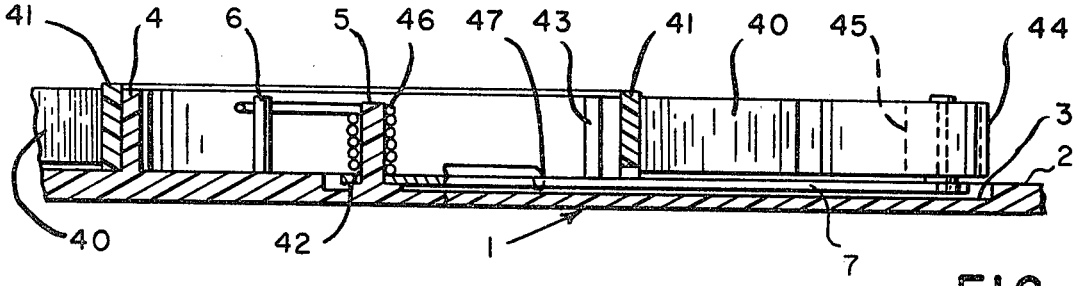
FIG. 5 is a view taken along the line 5—5 of FIG. 4.
Figure 6:
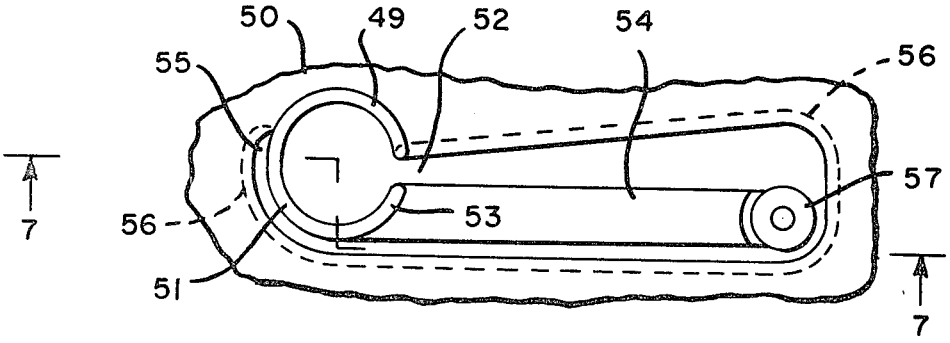
FIG. 6 is a sectional top view of another adjustable-diameter cartridge hub, according to another embodiment of the invention.
Figure 7:
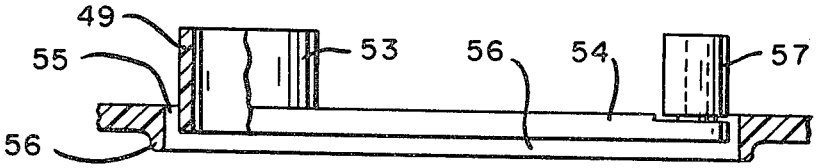
FIG. 7 is a view taken along the line 7—7 of FIG. 6.

While the embodiment of FIGS. 1 to 3 involves the use of a spring 19 to bias the pivot-supported hub brake section 17 away from the hub post 15, it is also possible to avoid the necessity of using both the spring 19 and the pivot 18 by attaching a flexible brake member such as a spring 46 of FIGS. 4 or 5 or a unitary curved plastic projection to the hub post 15, said spring 46 or plastic projection 51 of FIGS. 6 and 7 being biased away from the hub post 15, and the lever arm 23 being attached to said flexible brake member, 46 or 51, at a point adjacent to the attachment joint thereof to said hub post 15.

The lever arm 23 extends substantially radially from the hub member 16 in a direction which is substantially perpendicular to the direction of feed of the ribbon length 26 as it passes over the idler roller 24 and under ribbon guide 33 to the external ribbon guide 34. The essential requirement is that the angle of the lever arm 23, relative to the direction of feed of said ribbon 22, is such that the ribbon 22 being dispensed from the supply spool 21 is in a position to cause deflection or release of the lever arm 23 whether the supply spool 21 is full or nearly empty. Thus, it appears that the largest angle between the ribbon 22 being supplied to the idler roller 24 and the ribbon 26 being fed from said roller 24, i.e., when the supply spool 21 is nearly empty, preferably should not be greater than about 130° and most preferably should not be greater than about 100°.

As illustrated, the ribbon length 26 external to the cartridge 10 passes between the external ribbon guides 34 and 35 and re-enters the cartridge 10, passing under idler roller 36 and between idler gear wheel 37 and drive gear wheel 38 and onto the take-up tool 39 which, together with gear wheel 38, is driven by the typewriter mechanism (not shown) to cause the ribbon 22 to be moved from the supply spool 21 to the take-up spool 39.

The embodiment of FIGS. 4 and 5 represents a simplified structure having fewer moving parts and enabling the main or lower section of the cartridge to be completely assembled, with the braking member in place, prior to the insertion of the supply ribbon.

Referring to FIGS. 4 and 5, the cartridge thereof is identical to that of FIGS. 1 to 3 except with respect to the mounting hub for the supply ribbon, the lever arm and its pivot support and spring, and the recessed portion of the cartridge floor, as illustrated.

Thus, the main or lower section 1 of the cartridge of FIGS. 4 and 5 comprises a floor 2 having a triangular recessed area 3, a circular hub comprising a fixed wall segment 4 integral with the floor 2 but having a void or cut-away acute arc section in recessed area 3. Floor 2 also has an integral arm shaft 5 which is not concentric with the hollow circular hub wall segment 4 and an integral spring retainer pin 6. Thus the entire cartridge section 1 can be molded from plastic material as a unitary element in a single step.

The purpose of the recessed floor area 3 and the void in the circular hub wall segment 4 is to accommodate a brake lever arm 7 on a horizontal plane at or slightly below the plane of the floor 2 so that the arm 7 is capable of free pivoting movement beneath the wound supply ribbon 40 and its core 41 and, conversely, the ribbon 40 and core 41 are capable of free rotation over the arm 7 when the arm 7 is pivoted from lock position, shown by means of broken lines in FIG. 4, to release position, shown by means of solid lines in FIG. 4.

The brake lever arm 7 is pivotally-attached to the arm shaft 5 by means of the pivot hole 42, arm shaft 7 being offset from the center of the hub wall segment 4 so that the pivot movement of the arm 7 is not radial. The shaft 5 which is attached to the cartridge floor recessed area 3 at a location which is below or offset from the center of the circular core-supporting hub wall segment 4 is shown in FIG. 4.

The reason for the offset of the arm 7 is to cause the pivoting movement of the arm 7 to be non-radial, whereby the integral brake stud 43 which is, in effect, a moveable segment of the hub wall segment 4 located in the void area of the fixed hub wall segment 4, is moved between a lock position and a release position when the arm 7 is pivoted between corresponding positions, as illustrated. In normal lock position the outer surface of the stud 43 engages the inner surface of the ribbon core 41 to prevent relative rotation between the ribbon core 41 and the hub wall segment 4 and stud 43. When the arm 7 is pivoted in a counterclockwise direction by the lifting action of the free end 44 of the ribbon 40 against the idler roller 45, caused by applying tension or pulling action on said ribbon end 44, the stud 43 moves out of engagement with the inner surface of the core 41 to release the core 41 and permit it to rotate freely around the hub wall segment 4, as illustrated by FIG. 5.

The brake lever arm 7 is normally biased in locking position such as by means of a coil spring 46, one end of which is attached to the arm 7 such as by engagement within a hole 47 therein and the other end of which is attached to the floor 2 of the cartridge section 1, such as by engagement with the spring retainer pin 6. The coil spring 46 is supported on the arm shaft 5 and is under slight tension when the arm 7 is in normal locking position and under increased tension when the arm 7 is pivoted to release position.

FIGS. 6 and 7 illustrate another embodiment in which a cartridge similar to that of FIGS. 4 and 5 can be molded as a unitary element incorporating the lever arm as a flexible extension of the spool supporting hub.

Thus, the lower cartridge section 48 of FIGS. 6 and 7 is molded from flexible plastic material, such as nylon, to incorporate a spool-supporting hub comprising a fixed half hub section 49 which is integral with the floor 50 of cartridge section 48, a flexible hub section 51 which is a molded curved extension of the fixed hub section 49 but is not attached to the floor 50, and a void 52 which enables the end 53 of flexible hub section 51 to flex towards and away from the fixed hub section 49 to decrease and increase the outer diameter of the total hub.

The flexible hub section 51 includes, as a molded extention thereof, a lever arm section 54 which is attached to the flexible hub section 51 at a position level with or below the level of the interior cartridge floor 50 to permit the arm section 54 to underlie the spooled ribbon, when present on the hub, and to flex or pivot within the recessed or cut-away portion 55 of the cartridge floor 50 without interference with said ribbon.

As illustrated, a raised rib 56 is molded around the underside of the opening 55 to protect the arm section 54 against contact with adjacent areas of the typewriter when the cassette is mounted therein.

As in FIGS. 4 and 5, the lever arm section 54 carries an idler roller 57 at the end thereof, beyond the outer circumference of a full ribbon spool, for engagement with the free end of the ribbon as the ribbon passes from the spool out of the cartridge.

A critical feature of the embodiment of FIGS. 6 and 7 is that the flexible hub section 51 is molded so that the end 53 thereof extends outwardly beyond the outer circumference of the fixed hub section 49 so that the outer circumference of the total hub, in relaxed condition, is not perfectly circular. However, when tension is applied by the ribbon to the idler roller 57 to flex or pivot the arm section 54 in a counterclockwise direction within the recess 55, the end 53 of the flexible hub section 51, which is integral with the arm section 54, is flexed upwardly and inwardly to reduce the diameter of the total hub and render the outer circumference of the total hub substantially circular. In such stressed condition, the total hub accommodates the core of the spooled ribbon for free rotation thereon but when the arm section 54 and flexible hub section 51 are relaxed, by removal of tension from idler roller 57, the memory characteristics of the flexible plastic from which the flexible hub section 51 is molded cause said section 51 to relax and expand against the inner surface of the ribbon core to lock the core to the hub and prevent further rotation.

As will be understood by those skilled in the art, the essential novelty of the present invention resides in the concept of an internal hub brake mechanism for a wound transfer ribbon contained within a cartridge, the release of said brake mechanism being activated by the free end of the ribbon when said end is exposed to the normal pulling force or tension exerted upon said ribbon and by the ribbon feeding mechanism of the typewriter or printing machine in which the cartridge is mounted.

Variations and modifications will be apparent to those skilled in the art within the scope of the appended claims.

I claim:

1. A ribbon cartridge containing a continuous length of transfer ribbon wound on a supply spool having a circular core member and moveable from said supply spool, through a transfer station external to said cartridge and back onto a take-up spool within said cartridge, said cartridge being suitable for use on a transfer imaging machine containing a means for moving said ribbon from said supply spool, through said transfer station and onto said take-up spool, said cartridge comprising a housing having fixed thereto a generally-circular hub supporting said circular core member of said supply spool for relative rotation thereon, said hub comprising a fixed portion which is fixed to said housing and a moveable portion which is moveable relative to said fixed portion between a relaxed position in which said moveable portion of said hub is biased to press against the inner surface of said core member to lock said core member to said hub, and a retracted position, in which said moveable portion of said hub is moved out of frictional engagement with the inner surface of said core member to permit rotation of said core member on said hub, said moveable portion of said hub comprising a lever arm extending therefrom beyond the outer circumference of the transfer ribbon wound on said core member and having a ribbon-engaging member which extends parallel to the width of the wound ribbon and which is engaged by the rear surface of said ribbon as said ribbon passes from said supply spool to said take-up spool, said lever arm being moveable under the effects of increased tension in the length of ribbon between said supply spool and said take-up spool to move the moveable portion of said hub to said retracted position to release the frictional engagement between the core member and the moveable portion of said hub and permit rotation of said supply spool and dispensing of ribbon therefrom.

2. A ribbon cartridge according to claim 1 in which said hub comprises two hemicylindrical sections, one section being a fixed portion which is fixed to said housing and the other section being a moveable portion which is pivotally attached relative to said fixed portion to provide a hub having an outer circumference which is adjustable between dimensions in which said outer circumference is equal to the inner circumference of said core member, in said relaxed position, and less than the inner circumference of said core member in said retracted position.

3. A ribbon cartridge according to claim 1 in which said fixed portion of said hub comprises a fixed cylindrical wall section having a void segment therein, and said moveable portion of said hub is adjustable within said void segment between said relaxed and retracted positions.

4. A ribbon cartridge according to claims 1, 2 or 3 in which said hub also comprises a spring element to bias the moveable portion of said hub into said relaxed position.

5. A ribbon cartridge according to claims 1, 2 or 3 in which the moveable portion of said hub is pivotally-attached to the cartridge housing for rotational movement about an axis which is not concentric with the center point of said hub.

6. A ribbon cartridge according to claim 3 in which the lever arm of said moveable hub section is positioned beneath said supply spool.

7. A ribbon cartridge according to claim 3 in which the housing comprises a floor which is recessed in the area of the void segment of the hub wall section to receive the lever arm and permit pivotal movement thereof between said relaxed and said retracted positions.

* * * * *

UNITED STATES PATENT AND TRADEMARK OFFICE

CERTIFICATE OF CORRECTION

PATENT NO. : 4,350,454

DATED : September 21, 1982

INVENTOR(S) : William Schoenlein

It is certified that error appears in the above-identified patent and that said Letters Patent are hereby corrected as shown below:

On the Front Page of the Printed Patent:

Item 73 Assignee: Change "IBM Patent Operations, Lexington, Ky." to read --International Business Machines Corporation, Armonk, N.Y.--.

Signed and Sealed this

*First* Day of *February 1983*

[SEAL]

*Attest:*

GERALD J. MOSSINGHOFF

*Attesting Officer*

*Commissioner of Patents and Trademarks*